US012247819B2

(12) United States Patent
Padgett et al.

(10) Patent No.: US 12,247,819 B2
(45) Date of Patent: Mar. 11, 2025

(54) TWO-PIECE INSERT AND/OR FLASH TUBE FOR POLYMER AMMUNITION CARTRIDGES

(71) Applicant: PCP Tactical, LLC, Vero Beach, FL (US)

(72) Inventors: Charles Padgett, Vero Beach, FL (US); Lanse Padgett, Vero Beach, FL (US)

(73) Assignee: PCP Tactical, LLC, Sebastian, FL (US)

( * ) Notice: Subject to any disclaimer, the term of this patent is extended or adjusted under 35 U.S.C. 154(b) by 0 days.

(21) Appl. No.: 17/550,636

(22) Filed: Dec. 14, 2021

(65) Prior Publication Data

US 2022/0099418 A1 Mar. 31, 2022

Related U.S. Application Data

(60) Continuation of application No. 15/482,068, filed on Apr. 7, 2017, now abandoned, which is a (Continued)

(51) Int. Cl.
*F42B 5/307* (2006.01)
*F42C 19/08* (2006.01)

(52) U.S. Cl.
CPC ..... *F42B 5/307* (2013.01); *F42C 19/0826* (2013.01); *F42C 19/083* (2013.01)

(58) Field of Classification Search
CPC .... F42B 5/26; F42B 5/285; F42B 5/30; F42B 5/307; F42B 5/313; F42C 19/08; (Continued)

(56) References Cited

U.S. PATENT DOCUMENTS

RE2,716 E 8/1867 Milbank
180,840 A * 8/1876 Bull ..... F42C 19/0826 102/430

(Continued)

FOREIGN PATENT DOCUMENTS

AU 1350583 A 10/1983
BE 709551 A 5/1968

(Continued)

OTHER PUBLICATIONS

Chung, Jerry S.; Alternative Cartridge Case Material and Design; Armament Research, Development and Engineering Center Technical Report ARAEW-TR-05007, May 2005.

(Continued)

*Primary Examiner* — James S Bergin
(74) *Attorney, Agent, or Firm* — Troutman Pepper Locke LLP

(57) ABSTRACT

A high strength polymer-based cartridge casing can include an upper polymer component, molded from a polymer. The upper component has a first end having a mouth, at least a wall between the first end and a second end of the upper component opposite the first end, an overlap portion extending from the wall near the second end. An upper insert is included and has a first end and an opposing second end, a molded area disposed approximate the first end, that engages the overlap portion to join the upper polymer component and the upper insert, and an insert engagement area disposed approximate to the second end. Further, a lower insert has a front end and a back end, an upper insert engagement area engaging with the insert engagement area, a rim and groove disposed around an outside of the lower insert, and a primer pocket disposed inside the back end. Lastly, a flash hole is inside the lower insert and communicates between the primer pocket and upper polymer component.

2 Claims, 8 Drawing Sheets

Related U.S. Application Data continuation-in-part of application No. 15/463,906, filed on Mar. 20, 2017, now Pat. No. 9,989,343, and a continuation-in-part of application No. 15/187,421, filed on Jun. 20, 2016, now Pat. No. 9,995,561, and a continuation-in-part of application No. 15/043,026, filed on Feb. 12, 2016, now abandoned, said application No. 15/187,421 is a continuation of application No. 14/642,922, filed on Mar. 10, 2015, now Pat. No. 9,372,054, said application No. 15/043,026 is a continuation of application No. 14/531,124, filed on Nov. 3, 2014, now Pat. No. 9,261,335, said application No. 15/463,906 is a continuation-in-part of application No. 14/482,843, filed on Sep. 10, 2014, now Pat. No. 9,599,443, which is a continuation of application No. 14/460,877, filed on Aug. 15, 2014, now Pat. No. 9,194,680, said application No. 14/642,922 is a continuation of application No. 14/315,564, filed on Jun. 26, 2014, now Pat. No. 9,003,973, said application No. 14/482,843 is a continuation of application No. 14/041,709, filed on Sep. 30, 2013, now abandoned, said application No. 14/531,124 is a division of application No. 13/865,040, filed on Apr. 17, 2013, now Pat. No. 8,875,633, said application No. 14/482,843 is a continuation of application No. 13/865,040, filed on Apr. 17, 2013, now Pat. No. 8,875,633, said application No. 14/460,877 is a division of application No. 13/836,192, filed on Mar. 15, 2013, now Pat. No. 8,807,008, said application No. 14/315,564 is a division of application No. 13/549,351, filed on Jul. 13, 2012, now Pat. No. 8,763,535, said application No. 13/836,192 is a continuation-in-part of application No. 13/350,607, filed on Jan. 13, 2012, now Pat. No. 8,443,730, said application No. 13/865,040 is a division of application No. 13/350,607, filed on Jan. 13, 2012, now Pat. No. 8,443,730, said application No. 14/482,843 is a continuation of application No. 13/350,585, filed on Jan. 13, 2012, now abandoned, said application No. 13/549,351 is a continuation-in-part of application No. 13/350,585, filed on Jan. 13, 2012, now abandoned, said application No. 14/041,709 is a continuation of application No. 12/847,319, filed on Jul. 30, 2010, now Pat. No. 8,573,126.

(60) Provisional application No. 62/319,609, filed on Apr. 7, 2016, provisional application No. 61/555,684, filed on Nov. 4, 2011, provisional application No. 61/532,044, filed on Sep. 7, 2011, provisional application No. 61/509,337, filed on Jul. 19, 2011, provisional application No. 61/433,170, filed on Jan. 14, 2011.

(58) Field of Classification Search
CPC ..... F42C 19/0823; F42C 19/0826; F42C 19/083; F42C 19/0807
USPC ..... 102/464, 466, 467, 469, 470
See application file for complete search history.

(56) References Cited

U.S. PATENT DOCUMENTS 398,823 A * 3/1889 Emmens ..... F42B 5/36 102/470
1,038,078 A 9/1912 Bjorgum
1,118,888 A 11/1914 Butler
1,233,071 A 7/1917 Lindquist
1,292,359 A 1/1919 Nelson
1,319,185 A 10/1919 Smith et al.
2,022,685 A 12/1935 Moore
2,263,941 A 11/1941 George
2,269,316 A 1/1942 O'Neil
2,294,822 A 9/1942 George
2,366,887 A 1/1945 Warren
2,379,510 A 7/1945 Ewart
2,395,460 A 2/1946 Carten
2,401,050 A 5/1946 Cooper et al.
2,402,068 A 6/1946 Meador
2,426,448 A 8/1947 Goldfisher
2,430,888 A 11/1947 Regad et al.
2,435,590 A 2/1948 Holroyd
2,455,080 A 11/1948 Miller et al.
2,481,726 A 9/1949 Muschamp
2,489,953 A 11/1949 Dennistoun
2,648,258 A 8/1953 Simpson
2,654,319 A 10/1953 Roske
2,862,446 A 8/1955 Ringdal
2,915,947 A 12/1959 Heeley
2,918,868 A 12/1959 Ringdal
2,995,090 A 8/1961 Daubenspeck
3,034,433 A 5/1962 Gronn
3,078,765 A 2/1963 Falcone et al.
3,099,958 A 8/1963 Daubenspeck et al.
3,123,003 A 3/1964 Lange et al.
3,144,827 A 8/1964 Boutwell et al.
3,170,401 A 2/1965 Johnson et al.
3,233,546 A 2/1966 Foote et al.
3,253,512 A 5/1966 Schallehn
3,288,066 A 11/1966 Stadler et al.
3,333,506 A 8/1967 Henshaw
3,336,871 A 8/1967 Quinlan
3,339,487 A 9/1967 Umbach
3,424,089 A 1/1969 Humpherson
3,485,170 A 12/1969 Scanlon
3,609,904 A 10/1971 Scanlon
3,650,176 A 3/1972 Lindner
3,659,528 A 5/1972 Santala
3,696,705 A 10/1972 Hrabovsky
3,706,260 A 12/1972 Rausing
3,712,172 A 1/1973 Wiese
3,726,218 A 4/1973 Austin et al.
3,732,826 A 5/1973 Johnson
3,745,924 A 7/1973 Scanlon
3,749,020 A 7/1973 Weyhmuller
3,749,021 A 7/1973 Burgess
3,749,023 A 7/1973 Kawaguchi et al.
3,785,293 A 1/1974 Barr
3,797,396 A 3/1974 Reed
3,808,974 A 5/1974 Herter
3,818,834 A 6/1974 Baumgartener
3,830,157 A 8/1974 Donnard et al.
3,842,739 A 10/1974 Scanlon et al.
3,855,686 A 12/1974 Snyder
3,861,308 A 1/1975 Grandy
3,874,294 A 4/1975 Hale
3,913,445 A 10/1975 Grandy
3,935,816 A 2/1976 Boquette
3,948,178 A 4/1976 Luther et al.
3,955,506 A 5/1976 Luther et al.
3,977,326 A 8/1976 Anderson et al.
3,983,990 A 10/1976 Gardy et al.
3,990,366 A 11/1976 Scanlon
3,999,482 A 12/1976 Bilek
4,004,491 A 1/1977 Seeling
4,004,492 A 1/1977 Savioli
4,007,686 A 2/1977 Hugonet
4,038,923 A 8/1977 Cole et al.
4,089,612 A 5/1978 Mazzeo
4,140,058 A 2/1979 Ballreich et al.
4,142,466 A 3/1979 Ballreich et al.
4,147,107 A 4/1979 Ringdal
4,149,465 A 4/1979 Verkozen
4,157,684 A 6/1979 Clausser
4,165,943 A 8/1979 Beach et al.
4,173,186 A 11/1979 Dunham
4,187,271 A 2/1980 Rolston et al.
4,290,339 A 9/1981 Skahill

(56) References Cited

U.S. PATENT DOCUMENTS 4,359,925 A 11/1982 Abet et al.
4,446,794 A 5/1984 Simmons
4,469,027 A 9/1984 Burns et al.
4,474,102 A 10/1984 Tassie
4,498,396 A 2/1985 Berube
4,508,036 A 4/1985 Jensen et al.
4,546,704 A 10/1985 Ballreich et al.
4,553,479 A 11/1985 Willoughby
4,562,768 A 1/1986 Weinfurth et al.
4,572,078 A 2/1986 Bell
H61 H 5/1986 Yuhash et al.
4,593,621 A 6/1986 Buchner
4,620,485 A 11/1986 Bertiller
4,683,170 A 7/1987 Tse et al.
4,697,523 A 10/1987 Saxby
4,719,859 A 1/1988 Ballreich et al.
4,726,296 A 2/1988 Leshner et al.
4,738,202 A 4/1988 Hebert
4,790,231 A 12/1988 Stoner
4,803,926 A 2/1989 Barton et al.
4,809,612 A 3/1989 Ballreich et al.
4,841,837 A 6/1989 Novet
4,867,065 A 9/1989 Kaltmann et al.
5,021,206 A 6/1991 Stoops
5,033,386 A 7/1991 Vatsvog
5,063,853 A 11/1991 Bilgeri
5,090,327 A 2/1992 Bilgeri
5,138,949 A 8/1992 Swartout et al.
5,151,555 A 9/1992 Vatsvog
5,155,295 A 10/1992 Campoli
5,165,040 A 11/1992 Andersson et al.
5,233,928 A 8/1993 Ducros et al.
5,237,930 A 8/1993 Belanger et al.
5,259,288 A 11/1993 Vatsvog
5,259,319 A 11/1993 Dravecky et al.
5,265,540 A 11/1993 Ducros et al.
5,277,119 A 1/1994 Ricco
5,359,937 A 11/1994 Dittrich
5,368,526 A 11/1994 Hynes
5,460,096 A 10/1995 Kothe
5,492,063 A 2/1996 Dittrich
5,507,232 A 4/1996 Valdez
5,563,365 A 10/1996 Dineen et al.
5,616,642 A 4/1997 West et al.
5,653,563 A 8/1997 Ernst et al.
5,677,505 A 10/1997 Dittrich
5,703,322 A 12/1997 Tidman
5,708,231 A 1/1998 Koon
5,750,918 A 5/1998 Mangolds et al.
5,770,815 A 6/1998 Watson
5,822,904 A 10/1998 Beal
5,841,062 A 11/1998 Manole et al.
5,893,959 A 4/1999 Muellich
5,969,288 A 10/1999 Baud
5,979,331 A 11/1999 Casull
6,041,712 A 3/2000 Lyon
6,048,379 A 4/2000 Bray et al.
6,074,454 A 6/2000 Abrams et al.
6,101,949 A 8/2000 Maucourt et al.
6,131,519 A 10/2000 Thiesen et al.
6,164,209 A 12/2000 Best et al.
6,257,149 B1 7/2001 Cesaroni
6,283,035 B1 9/2001 Olson et al.
6,367,386 B1 4/2002 Brede et al.
6,430,861 B1 8/2002 Ayers et al.
6,439,123 B1 8/2002 Dionne et al.
6,523,476 B1 2/2003 Riess et al.
6,539,874 B2 4/2003 Weise
6,584,909 B2 7/2003 Brede et al.
6,598,536 B2 7/2003 Burri
6,600,002 B2 7/2003 Sanderson et al.
6,748,870 B2 6/2004 Heidenreich et al.
6,752,084 B1 6/2004 Husseini et al.
6,832,557 B2 12/2004 Torsten
6,845,716 B2 1/2005 Husseini et al.
6,862,993 B1 3/2005 Cudazzo
6,886,467 B1 5/2005 Haeselich
6,988,450 B1 1/2006 Georgantzis et al.
7,004,074 B2 2/2006 Van Stratum
7,032,492 B2 4/2006 Meshirer
7,059,234 B2 6/2006 Husseini
7,086,336 B2 8/2006 Smalley et al.
7,165,496 B2 1/2007 Reynolds
7,204,191 B2 4/2007 Wiley et al.
7,213,519 B2 5/2007 Wiley et al.
7,231,519 B2 6/2007 Joseph et al.
7,406,908 B1 8/2008 Goon et al.
7,441,504 B2 10/2008 Husseini et al.
7,610,858 B2 11/2009 Chung
7,938,067 B2 5/2011 Dindl
8,087,359 B2 1/2012 Sauvestre
8,146,281 B2 4/2012 Zimmerman
8,151,683 B2 4/2012 Pick et al.
8,240,252 B2 8/2012 Maljkovic et al.
8,342,072 B2 1/2013 Abbott
8,443,730 B2 5/2013 Padgett
8,522,684 B2 9/2013 Davies et al.
8,561,543 B2 10/2013 Burrow
8,573,126 B2 11/2013 Klein et al.
8,807,008 B2 8/2014 Padgett et al.
8,875,633 B2 11/2014 Padgett
9,091,516 B2 7/2015 Davies et al.
9,194,680 B2 11/2015 Padgett et al.
9,273,942 B1 3/2016 Burke et al.
9,625,241 B2 4/2017 Neugebauer
9,891,030 B1 2/2018 Kley
9,939,236 B2 4/2018 Drobockyi et al.
10,132,601 B2 11/2018 Nemec
10,209,042 B2 2/2019 Baxter et al.
10,907,943 B2 * 2/2021 Beach ..... F42B 33/0207
10,948,272 B1 * 3/2021 Drobockyi ..... F42B 5/02
11,125,540 B2 * 9/2021 Pennell ..... F42B 35/02
11,199,384 B2 * 12/2021 Koh ..... F42B 5/26
2002/0195017 A1 12/2002 Priimak
2003/0019385 A1 1/2003 Leasure et al.
2003/0167952 A1 9/2003 Heidenreich et al.
2003/0172775 A1 9/2003 Amick
2004/0011237 A1 1/2004 Khvichia et al.
2004/0226472 A1 11/2004 Oda
2004/0237827 A1 12/2004 Smalley et al.
2005/0188879 A1 9/2005 Wiley et al.
2005/0188883 A1 9/2005 Husseini et al.
2005/0257711 A1 11/2005 Husseini et al.
2005/0257712 A1 11/2005 Husseini et al.
2006/0011087 A1 1/2006 Husseini et al.
2006/0102041 A1 5/2006 Wiley et al.
2006/0207464 A1 9/2006 Malijkovic et al.
2007/0193465 A1 8/2007 Stevens
2007/0214992 A1 9/2007 Dittrich
2007/0261587 A1 11/2007 Chung
2008/0245219 A1 10/2008 Moucheboeuf et al.
2009/0044717 A1 2/2009 Husseini et al.
2009/0114109 A1 5/2009 Overton et al.
2009/0151710 A1 6/2009 Zimmerman
2009/0249947 A1 10/2009 Coiffet et al.
2010/0056687 A1 3/2010 Diakoumakos et al.
2010/0275804 A1 11/2010 Trivette
2010/0282112 A1 11/2010 Battaglia
2010/0305261 A1 12/2010 Maljkovic et al.
2011/0000391 A1 1/2011 Heitmann
2011/0179965 A1 7/2011 Mason
2011/0214583 A1 9/2011 Dutch
2011/0252999 A1 10/2011 Carlson et al.
2011/0290141 A1 12/2011 Engel
2011/0290143 A1 12/2011 Heitmann et al.
2012/0024183 A1 2/2012 Klein
2012/0060716 A1 3/2012 Davies et al.
2012/0111219 A1 5/2012 Burrow
2012/0118132 A1 5/2012 Coker et al.
2012/0144712 A1 6/2012 Rostocil
2012/0174813 A1 7/2012 Battaglia
2012/0180687 A1 7/2012 Padgett
2012/0180688 A1 7/2012 Padgett
2012/0318128 A1 12/2012 Gotie

(56) References Cited

U.S. PATENT DOCUMENTS

| | | | |
|---|---|---|---|
| 2013/0014664 | A1 | 1/2013 | Padgett |
| 2013/0025490 | A1 | 1/2013 | Burczynski |
| 2013/0186294 | A1 | 7/2013 | Davies et al. |
| 2014/0060372 | A1 | 3/2014 | Padgett |
| 2014/0060373 | A1 | 3/2014 | Maljkovic |
| 2014/0069290 | A1 | 3/2014 | Padgett et al. |
| 2014/0130699 | A1 | 5/2014 | Peterson et al. |
| 2014/0373744 | A1 | 12/2014 | Padgett et al. |
| 2016/0018199 | A1 | 1/2016 | Nemec |
| 2016/0054105 | A1 | 2/2016 | Beal |
| 2016/0131463 | A1 | 5/2016 | Stauffer |

FOREIGN PATENT DOCUMENTS

| | | | |
|---|---|---|---|
| CH | 370676 | A | 7/1963 |
| DE | 1113880 | | 9/1961 |
| DE | 1453845 | A1 | 9/1969 |
| DE | 2205619 | A1 | 8/1972 |
| DE | 3344369 | A1 | 6/1985 |
| EP | 0096617 | | 12/1983 |
| EP | 131863 | | 1/1985 |
| EP | 444545 | A1 | 9/1991 |
| EP | 526317 | A1 | 2/1993 |
| FR | 1081764 | A | 12/1954 |
| FR | 2252548 | A1 | 6/1975 |
| GB | 616755 | A | 1/1949 |
| GB | 732633 | A | 6/1955 |
| GB | 2092274 | A1 | 8/1982 |
| WO | 88/09476 | A1 | 12/1988 |
| WO | 95/13516 | A1 | 5/1995 |
| WO | 99/18408 | A1 | 4/1999 |
| WO | 2003/036222 | | 5/2003 |
| WO | 2005/022072 | | 3/2005 |
| WO | 2006/094987 | | 9/2006 |
| WO | 2010/129781 | | 11/2010 |
| WO | 2012/047615 | A1 | 4/2012 |
| WO | 2012/097317 | A2 | 7/2012 |
| WO | 2012/097317 | A3 | 7/2012 |
| WO | 2012/097320 | A1 | 7/2012 |

OTHER PUBLICATIONS

File history of U.S. Appl. No. 61/456,664, which corresponds to US 2012/0111219.

International Search Report, dated May 23, 2012, which issued during the prosecution of International Patent Application No. PCT/US2012/021350.

International Search Report, dated Aug. 24, 2012, which issued during the prosecution of International Patent Application No. PCT/US2012/021345.

Extended European Search Report dated May 15, 2014, from European Application Application No. 14161688.8.

European Search Report dated Jul. 28, 2014, which issued during prosecution of European Application No. 14161657.3.

European Search Report dated Jul. 28, 2014, issued during prosecution of European Application No. 14161657.3.

International Search Report dated Sep. 19, 2014, which issued during prosecution of International Application No. PCT/US2013/050358.

Extended European Search Report dated Jul. 16, 2015, issued in corresponding European Patent Application No. 15158374.7.

Extended European Search Report dated Jun. 23, 2015 issued in corresponding European Patent Application No. 15156909.2.

European Office Action dated Feb. 9, 2016, issued in corresponding Application No. 14161657.3-1655.

EPO Communication dated Jul. 13, 2016 issued in corresponding European Patent Application No. 15157354.0.

EPO Communication dated Jul. 15, 2016 issued in corresponding European Patent Application No. 15156909.2.

EPO Communication dated Jul. 15, 2016 issued in corresponding European Patent Application No. 15158374.7.

Australian Office Action dated Jan. 9, 2017 issued in corresponding Australian Patent Application No. 2015261552.

* cited by examiner

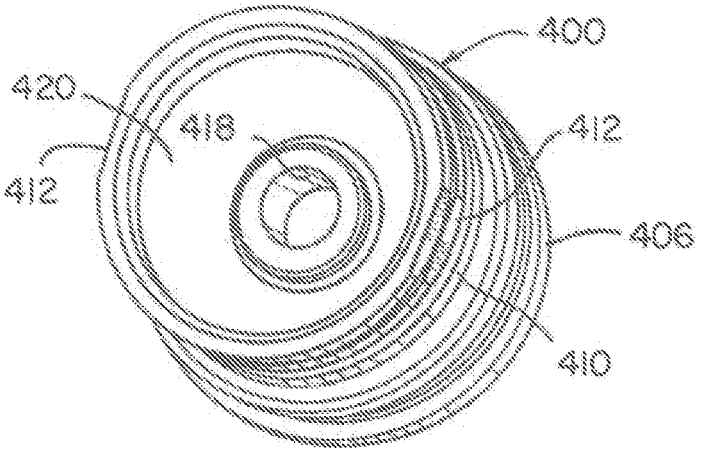
FIG 7
FIG 8
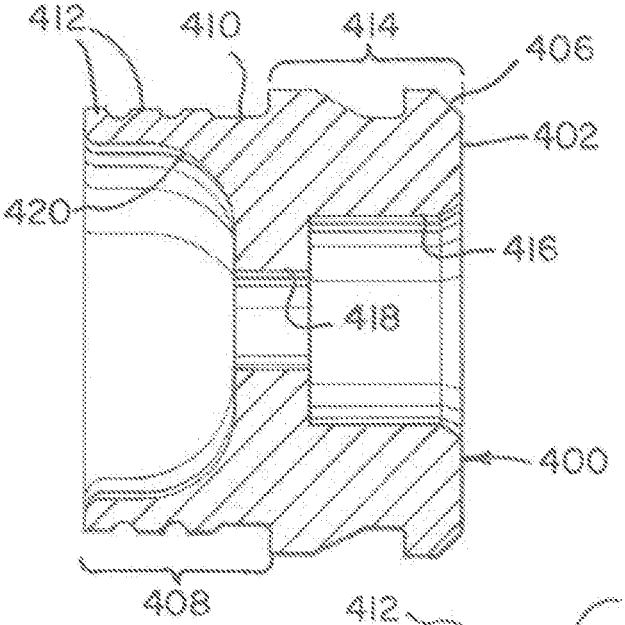
FIG 9A
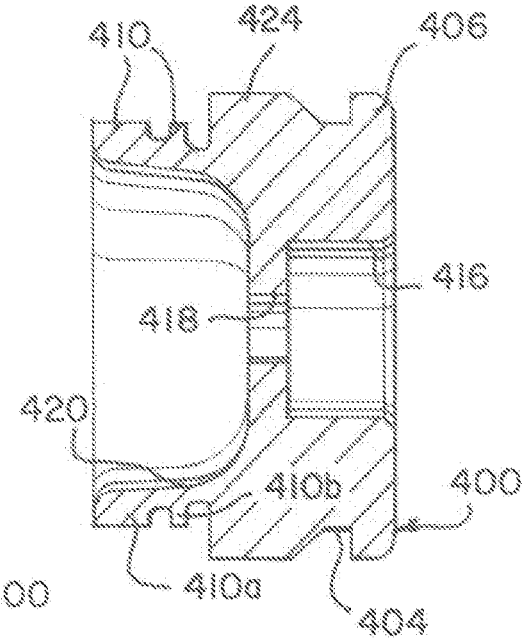
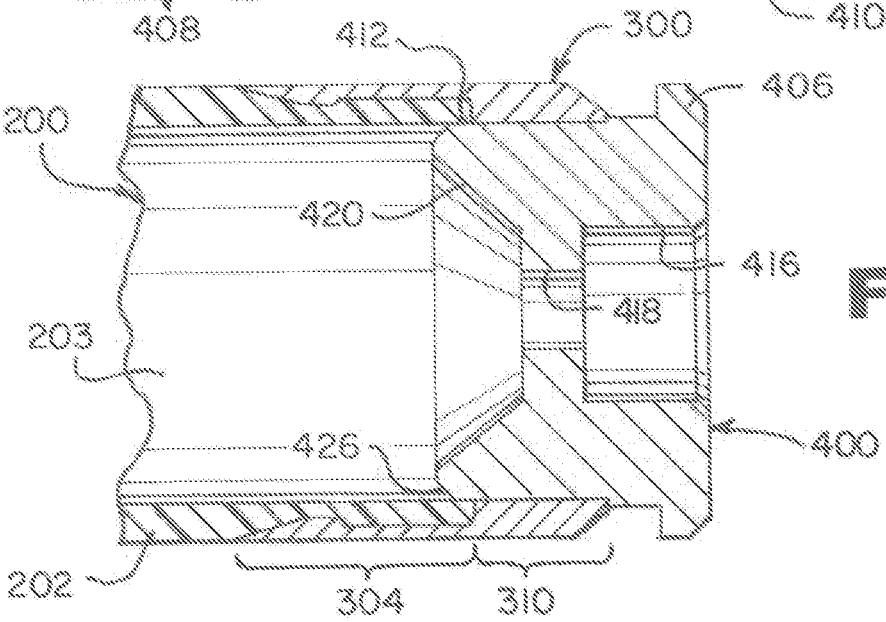
FIG 9B

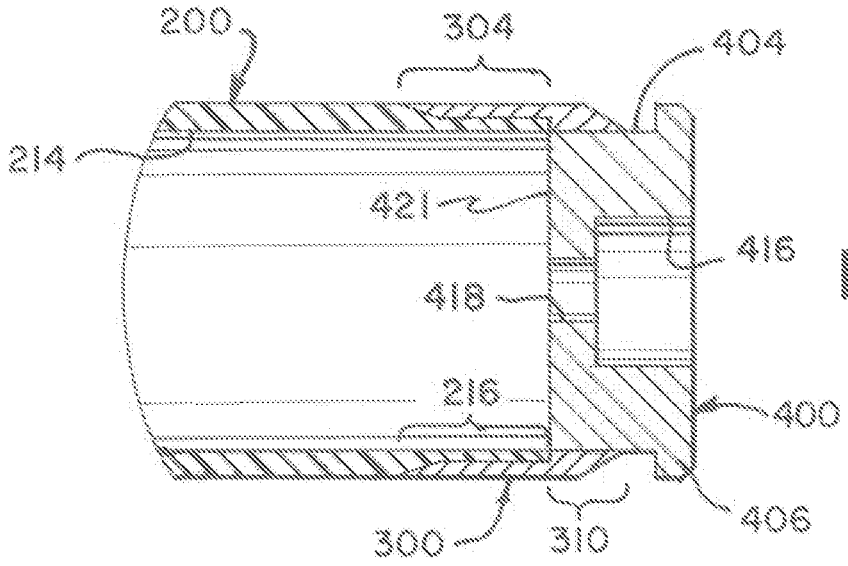
FIG 10
FIG 11A
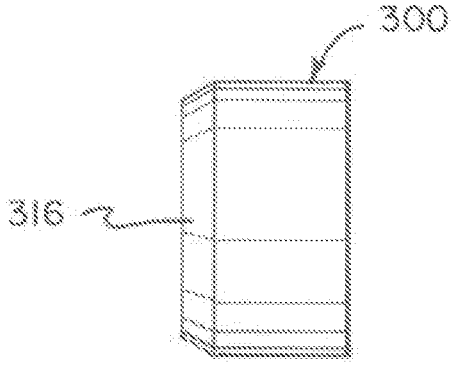
FIG11B
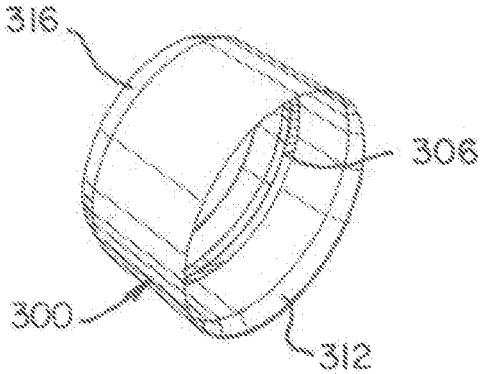
FIG12A
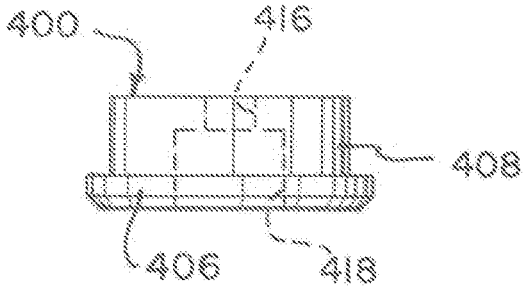
FIG 12B
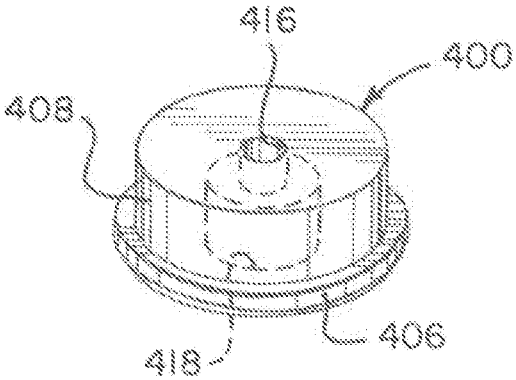

400
416
418
312
424
306
300
304
203
500
506
200
202
204
206
208
100

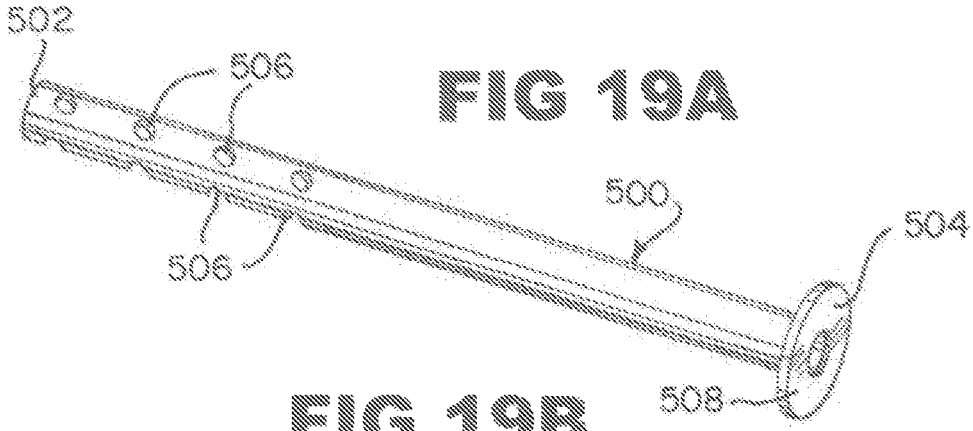
FIG 19A
FIG 19B
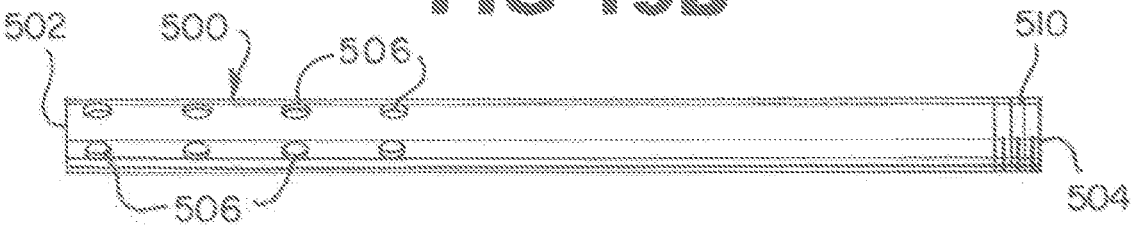
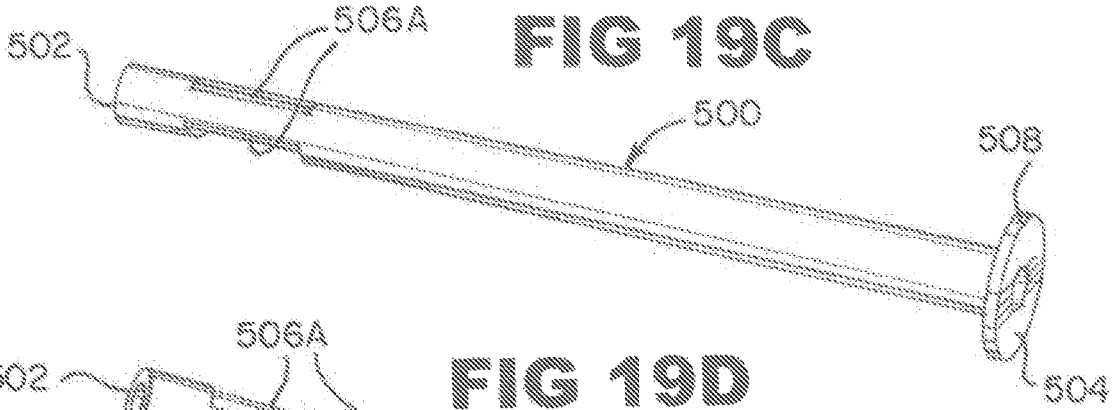
FIG 19C
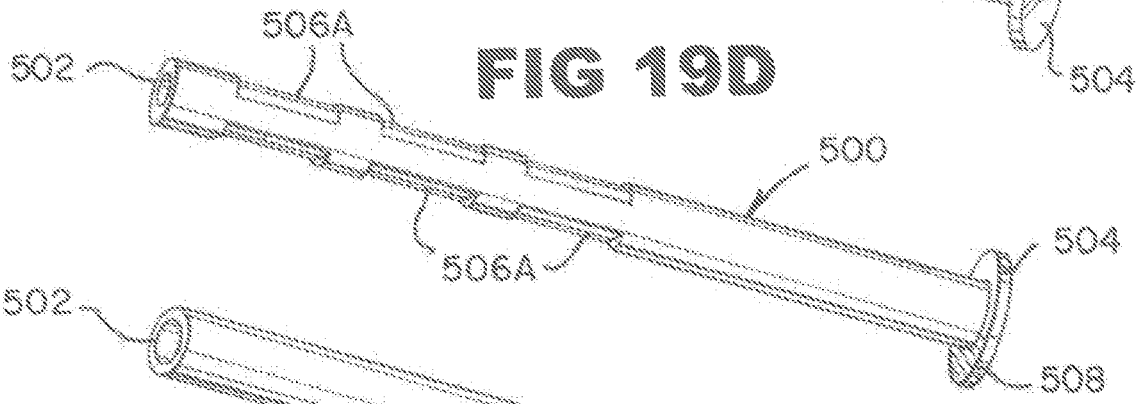
FIG 19D
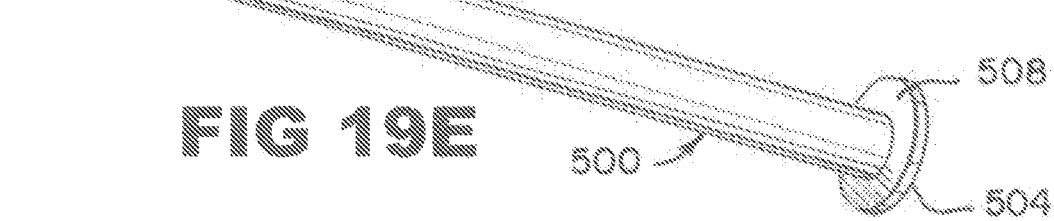
FIG 19E

TWO-PIECE INSERT AND/OR FLASH TUBE FOR POLYMER AMMUNITION CARTRIDGES

CROSS REFERENCE TO RELATED APPLICATIONS

This application is a continuation of U.S. patent application Ser. No. 15/482,068 filed Apr. 7, 2017, which claims priority to U.S. Provisional Application Ser. No. 62/319,609 filed Apr. 7, 2016.

U.S. patent application Ser. No. 15/482,068 filed Apr. 7, 2017 is also a Continuation-in-Part of U.S. patent application Ser. No. 15/043,026 filed Feb. 12, 2016, which is a Continuation of U.S. patent application Ser. No. 14/531,124 filed Nov. 3, 2014, now U.S. Pat. No. 9,261,335 issued Feb. 16, 2016, which is a Divisional of U.S. patent application Ser. No. 13/865,040 filed Apr. 17, 2013, now U.S. Pat. No. 8,875,633 issued Nov. 4, 2014, which is a Divisional of U.S. patent application Ser. No. 13/350,607 filed Jan. 13, 2012, now U.S. Pat. No. 8,443,730 issued May 21, 2013, which claims priority to U.S. Provisional Application No. 61/433,170 filed Jan. 14, 2011, U.S. Provisional Application No. 61/509,337 filed Jul. 19, 2011, U.S. Provisional Application No. 61/532,044 filed Sep. 7, 2011 and U.S. Provisional Application No. 61/555,684 filed Nov. 4, 2011.

U.S. patent application Ser. No. 15/482,068 filed Apr. 7, 2017 is also a Continuation-in-Part of U.S. patent application Ser. No. 15/187,421 filed Jun. 20, 2016, now U.S. Pat. No. 9,995,561 issued Jun. 12, 2018, which is a Continuation of U.S. patent application Ser. No. 14/642,922 filed Mar. 10, 2015, now U.S. Pat. No. 9,372,054 issued Jun. 21, 2016, which is a Continuation of U.S. patent application Ser. No. 14/315,564 filed Jun. 26, 2014, now U.S. Pat. No. 9,003,973 issued Apr. 14, 2015, which is Divisional of U.S. patent application Ser. No. 13/549,351 filed Jul. 13, 2012, now U.S. Pat. No. 8,763,535 issued Jul. 1, 2014, which is Continuation-in-Part of U.S. patent application Ser. No. 13/350,585, filed Jan. 13, 2012, which claims priority to U.S. Provisional Application No. 61/433,170 filed Jan. 14, 2011.

U.S. patent application Ser. No. 15/482,068 filed Apr. 7, 2017 is also a Continuation-in-Part of U.S. patent application Ser. No. 15/463,906 filed Mar. 20, 2017, now U.S. Pat. No. 9,989,343 issued Jun. 5, 2018, which is a Continuation of U.S. patent application Ser. No. 14/482,843 filed Sep. 10, 2014, now U.S. Pat. No. 9,599,443 issued Mar. 21, 2017.

U.S. patent application Ser. No. 14/482,843 filed Sep. 10, 2014, now U.S. Pat. No. 9,599,443 issued Mar. 21, 2017, is a Continuation of U.S. patent application Ser. No. 13/865,040 filed Apr. 17, 2013, now U.S. Pat. No. 8,875,633 issued Nov. 4, 2014, which is a Divisional of U.S. patent application Ser. No. 13/350,607 filed Jan. 13, 2012, now U.S. Pat. No. 8,443,730 issued May 21, 2013, which claims priority to U.S. Provisional Application No. 61/433,170 filed Jan. 14, 2011, U.S. Provisional Application No. 61/509,337 filed Jul. 19, 2011, U.S. Provisional Application No. 61/532,044 filed Sep. 7, 2011, and U.S. Provisional Application No. 61/555,684 filed Nov. 4, 2011.

U.S. patent application Ser. No. 14/482,843 filed Sep. 10, 2014, now U.S. Pat. No. 9,599,443 issued Mar. 21, 2017 is also a Continuation of U.S. patent application Ser. No. 14/460,877 filed Aug. 15, 2014, now U.S. Pat. No. 9,194,680 issued Nov. 24, 2015, which is a Divisional of U.S. patent application Ser. No. 13/836,192 filed Mar. 15, 2013, now U.S. Pat. No. 8,807,008 issued Aug. 19, 2014, which is a Continuation-in-Part of U.S. patent application Ser. No. 13/350,607 filed Jan. 13, 2012, now U.S. Pat. No. 8,443,730 issued May 21, 2013, which claims priority to U.S. Provisional Application No. 61/433,170 filed Jan. 14, 2011, U.S. Provisional Application No. 61/509,337 filed Jul. 19, 2011, U.S. Provisional Application No. 61/532,044 filed Sep. 7, 2011, and U.S. Provisional Application No. 61/555,684 filed Nov. 4, 2011.

U.S. patent application Ser. No. 14/482,843 filed Sep. 10, 2014, now U.S. Pat. No. 9,599,443 issued Mar. 21, 2017 is also a Continuation of U.S. patent application Ser. No. 13/350,585, filed Jan. 13, 2012, claims priority to U.S. Provisional Application No. 61/433,170 filed Jan. 14, 2011.

U.S. patent application Ser. No. 14/482,843 filed Sep. 10, 2014, now U.S. Pat. No. 9,599,443 issued Mar. 21, 2017 is also a Continuation of U.S. patent application Ser. No. 14/041,709 filed Sep. 30, 2013, which is a Continuation of Ser. No. 12/847,319 filed Jul. 30, 2010, now U.S. Pat. No. 8,573,126 issued Nov. 3, 2013.

All of the above applications are incorporated herein by reference.

FIELD OF INVENTION

The present subject matter relates to ammunition articles with plastic components such as cartridge casing bodies, and, more particularly, a two-piece insert used with the plastic cartridges.

BACKGROUND

It is well known in the industry to manufacture projectiles and corresponding cartridge cases from either brass or steel. Typically, industry design calls for materials that are strong enough to withstand extreme operating pressures and which can be formed into a cartridge case to hold the projectile, while simultaneously resist rupturing during the firing process.

Conventional ammunition typically includes four basic components, that is, the projectile, the cartridge case holding the projectile therein, a propellant used to push the projectile down the barrel at predetermined velocities, and a primer, which provides the spark needed to ignite the propellant which sets the projectile in motion down the barrel.

The cartridge case is typically formed from brass and is configured to hold the projectile therein to create a predetermined resistance, which is known in the industry as bullet pull. The cartridge case is also designed to contain the propellant media as well as the primer. However, brass is heavy, expensive, and potentially hazardous. For example, the weight of .50 caliber ammunition is about 60 pounds per box (200 cartridges plus links).

The cartridge case, which is typically metallic, acts as a payload delivery vessel and can have several body shapes and head configurations, depending on the caliber of the ammunition. Despite the different body shapes and head configurations, all cartridge cases have a feature used to guide the cartridge case, with a projectile held therein, into the chamber of the gun or firearm.

The primary objective of the cartridge case is to hold the projectile, primer, and propellant therein until the gun is fired. Upon firing of the gun, the cartridge case seals the chamber to prevent the hot gases from escaping the chamber in a rearward direction and harming the shooter. The empty cartridge case is extracted manually or with the assistance of gas or recoil from the chamber once the gun is fired.

One of the difficulties with polymer ammunition is having enough strength to withstand the pressures of the gases generated during firing. In some instances, the polymer may have the requisite strength, but be too brittle at cold temperatures, and/or too soft at very hot temperatures. Additionally, the spent cartridge is extracted at its base, and that portion must withstand the extraction forces generated from everything from a bolt action rifle to a machine gun.

A number of U.S. patents and applications by Padgett, see above, disclose a single metal insert with a one or two piece polymer cartridge case. The two-piece case facilitates the manufacturing of a bottleneck cartridge. Molding a polymer cartridge requires a "pin" to be inserted into a mold to form the polymer and then extracted. The wider diameter of the powder chamber of a standard bottleneck cartridge opposed to the diameter of the mouth makes it impossible to remove the molding pin. The two-piece design allows a pin to be inserted through the wider bottom to the narrower neck. The second piece of the cartridge can overmold the metal insert for maximum strength and the two polymer sections can be fused together. For a blank or subsonic polymer cartridge, the walls can be made straight from the mouth which eliminates the need for an internal diameter change.

Hence a need exists for a polymer casing that can perform as well as or better than the brass alternative. A further improvement is the base inserts to the polymer casings that are capable of withstanding all of the stresses and pressures associated with the loading, firing and extraction of the casing, while reducing manufacturing costs and maintaining strength.

Turning now to the concept of flash tubes, it is not new and is currently used in many large caliber weapon systems. The flash tube is essentially a tube that runs through the center of the cartridge from the primer pocket to the middle area of the case with the goal of enhancing the ignition of the propellant charge.

In large caliber weapons, the flash tube is often filled with an extremely fast burning propellant such as black powder. These flash tubes often have vents in multiple locations along the axis of the tube to ignite the powder in the cartridge at the same time resulting in better ignition.

In small caliber ammunition, the propellant volume is not significant enough to warrant the need for such a device. That said, research conducted during World War II and again in the 1970's using a flash tube vented only at the top showed that the ignition of the propellant in a 50 BMG case could be significantly improved.

During the 1930's, small arms expert Elmer Keith proposed that the use of a flash tube in small caliber ammunition could result in better performance. The concept can be reduced to this: igniting the powder column near the top of the cartridge would result in the powder burning top down thus keeping the propellant in the case instead of propelling it down the bore. By keeping the powder in the case until fully consumed, the heat of combustion would be better localized enhancing the burn and reducing the heat generated in the bore. This has the added benefit of reducing barrel erosion caused by the "sand blasting effect" of the powder granules being propelled down the bore. Using this pioneering technique, Mr. Keith was able to maintain the same velocity as the standard cartridge, yet peak chamber pressure was reduced by close to 10,000 PSI. He termed this method as Duplex Loading. This should not be confused with current use of the term which describes the use of one or more powders of varying burn rate stacked in a case.

The use of the flash tube is now better known as front or forward priming. Mr. Keith continued his testing and showed because the pressure had been reduced, he could increase the charge to get back to "normal" pressures resulting in substantial velocity increases.

During WWII, Mr Keith was called to Frankford Arsenal to work on the .50 caliber cartridge using his forward priming technique. Using this technique, Mr Keith was able to produce documented increases in velocity of 200 fps. Unfortunately due to the conflict at hand, the research was concluded as the army deemed that changes to an already extremely effective cartridge would be inadvisable at a time when maximum production was the primary goal. The work on the forward primed .50 caliber cartridge was essentially dropped and never really picked up again by the army.

Mr Keith continued his work on small caliber ammunition, employing his forward priming technique on the 30-06 cartridge and eventually forming a small ammunition company. Though the results of his efforts showed great promise, manufacturing processes kept the technique from the larger market.

Later in the 1970's, Richard Culver picked up where Mr. Keith left off and began testing forward priming as well as duplex and triplex loading. I will not cover the research associated with duplex and triplex loading due to the fact that the results can have disastrous effects, but Mr. Culver's testing of the forward priming confirmed Mr Keith's earlier work conclusively.

Culver used the 30-06 and 7.62 NATO cartridges for his study. He produced cases using a flash tube very similar to what Mr Keith described. Culver created a very detailed experimental study to test the effects of a flash tube in small caliber ammunition. His work was based on the concepts that Mr Keith has postulated, that the forward priming had two significant benefits. The first is directing the primer blast toward the base of the projectile and the second being the ignition of the top of the powder charge first. The initial primer blast propels the projectile into the bore, sealing it, before the charge is ignited thus increasing the volume prior to ignition. This has the effect of reducing the peak pressure. In conventionally loaded ammunition, the charge is ignited from the rear forward resulting in much of the charge burning prior to any movement of the projectile.

The results of Mr Culver's experiments confirmed that forward priming of a 7.62 cartridge significantly reduced the peak pressures for a given load. He furthered the testing to increase the pressure back to normal by increasing the load and was able to gain an additional 100 fps while maintaining normal pressures.

Mr Culver proposed that these benefits could be extremely beneficial in machine gun use where the reduced barrel temperatures could allow for longer strings of firing without damaging the barrel. The reduced erosion could also increase barrel life. In his closing, he recommended that the 300 Win Mag cartridge was an ideal cartridge for further studying this technique due to is volume to bore diameter ratio. Some examples of forward primed brass cartridges are illustrated in FIGS. 21A and 21B.

SUMMARY

The examples of the present invention for a high strength polymer-based cartridge casing can include an upper polymer component, molded from a polymer. The upper component has a first end having a mouth, at least a wall between the first end and a second end of the upper component opposite the first end, an overlap portion extending from the wall near the second end. An upper insert is included and has a first end and an opposing second end, a molded area disposed approximate the first end, that engages the overlap portion to join the upper polymer component and the upper insert, and an insert engagement area disposed approximate to the second end. Further, a lower insert has a front end and a back end, an upper insert engagement area engaging with the insert engagement area, a rim and groove disposed around an outside of the lower insert, and a primer pocket disposed inside the back end. Lastly, a flash hole is inside the lower insert and communicates between the primer pocket and upper polymer component.

Another example of a high strength polymer-based cartridge casing has an upper polymer component, molded from a polymer, with a first end having a mouth, at least a wall between the first end and a second end of the upper component opposite the first end, a volume inside the wall at least partially forming a propellant chamber, and an overlap portion extending from the wall near the second end. Then an upper insert has a first end and an opposing second end with a molded area disposed approximate the first end that engages the overlap portion to join the upper polymer component and the upper insert. An insert engagement area is disposed approximate to the second end. A lower insert has a front end and a back end with an upper insert engagement area engaging with the insert engagement area, a rim and groove disposed around an outside of the lower insert, a primer pocket disposed inside the back end, and a flash hole, inside the lower insert and communicating between the primer pocket and upper polymer component. Additionally included is a flash tube in fluid communication with the primer pocket and the propellant chamber.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 7 is a bottom front perspective view of the lower insert of FIG. 6;

FIG. 8 is a longitudinal cross-section view of the lower insert of FIG. 6;

FIG. 9A is a longitudinal cross-section view of example of belted lower insert;

FIG. 9B is a cross-section view of another example of a basin lower insert installed;

FIG. 10 is a cross-section view of another example of the upper component, upper insert and lower insert engaged;

FIGS. 11A and 11B are side and side-back profile views, respectively, of another example of an upper insert;

FIGS. 12A and 12B are side and side-back profile views, respectively, of another example of a lower insert;

FIGS. 19A through 19E each illustrate different examples of flash tubes;

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The present example provides a cartridge case body strong enough to withstand gas pressures that equal or surpass the strength required of brass cartridge cases under certain conditions, e.g. for both storage and handling. At the same time, the cartridge can be easily produced and still maintain surpass brass cartridges.

Figure 1:
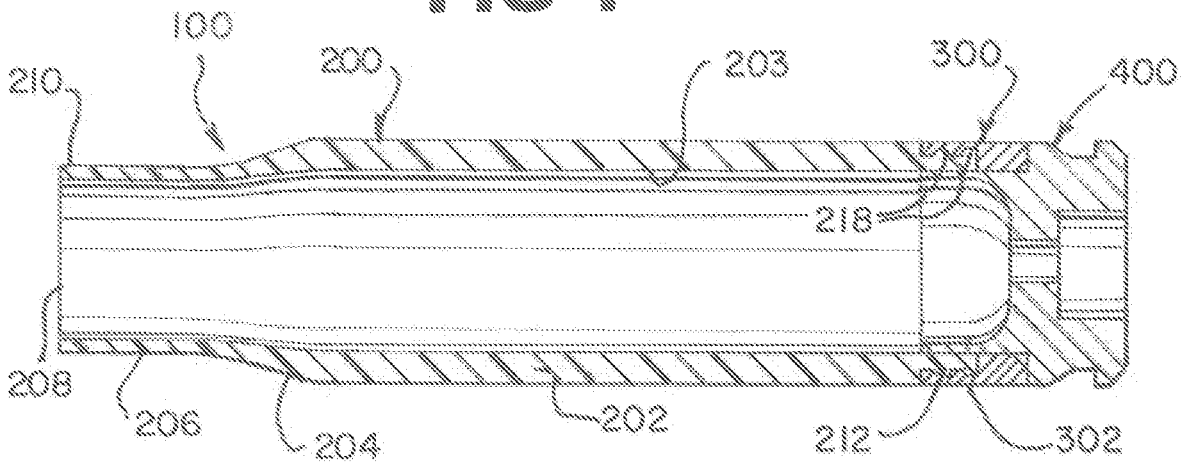
FIG. 1 is a cross-section of a bottle neck cartridge with a two-piece insert of the present invention.

Referring now to FIG. 1, a cross-section of a bottleneck cartridge case 100 is illustrated. The cartridge case 100 includes an upper polymer component 200, an upper insert 300, and a lower insert 400. In this example, the upper polymer component 200 is made of a polymer while the upper and lower inserts 300, 400 are made from a metal, an alloy of metals, or an alloy of a metal and a non-metal. Regardless of materials, the outer dimensions of the cartridge case 100 are within the acceptable tolerances for whatever caliber firearm it is designed to be loaded into.

The polymer used is lighter than brass. A high impact polymer can be used where the glass content is between 0%-50%. An example of an impact modified polymer is polyetherimide (PEI). Further examples include using polysulfones (PSU), polyphenylsulfone (PPSU), siloxane, polycarbonates, and any co-polymers, alloys or blends of the above.

The upper and lower inserts 300, 400 can be made of brass or steel, and, in examples, stainless steel. The nature of the features allows examples of the insert to be made of "softer" steel. Other examples use heat treated carbon steel, 4140. The 4140 steel has a rating on the Rockwell "C" scale ("RC") hardness of about 20 to about 50. However, any carbon steel with similar properties, other metals, metal alloys or metal/non-metal alloys can be used to form the inserts.

In an example, the upper component 200 is made of high impact polymer combined with the inserts 300, 400 made of brass or steel that result in a cartridge that is approximately 50% lighter than a brass formed counterpart. This weight savings in the unloaded cartridge produces a loaded cartridge of between 25%-30% lighter than the loaded brass cartridge depending on the load used, i.e. which projectile, how much powder, and type of powder used.

Figure 2:
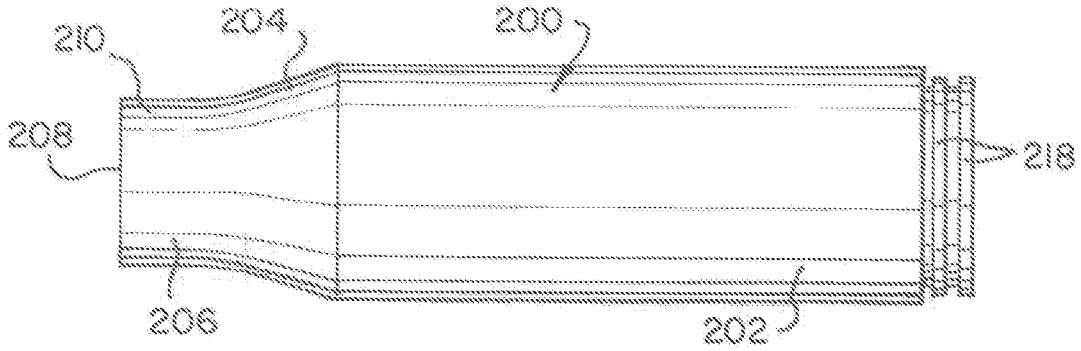
FIG. 2 illustrates a side view of an example of the upper component.

FIGS. 1 and 2 illustrate the upper component 200 with a body 202 which transitions into a shoulder 204 that tapers into a neck 206 having a mouth 208 at a first end 210. The upper component 200 joins the upper insert 300 at an opposite, second end 212. The body 202 generally forms a propellant chamber 203, as this holds the propellant (not illustrated) to propel the projectile (not illustrated) typically fitted into the mouth 208. The propellant chamber 203 can be a volume from the lower insert 400 to approximately the shoulder 204. A bottom of a projectile extends into the mouth 208 and past the neck 206, and this can act as the other "end" to the propellant chamber 203.

The propellant is typically a solid chemical compound in powder form commonly referred to as smokeless powder. Propellants are selected such that when confined within the cartridge case, the propellant burns at a known and predictably rapid rate to produce the desired expanding gases. The expanding gases of the propellant provide the energy force that launches the projectile from the grasp of the cartridge case 100 and propels the projectile down the barrel of the gun at a known and relatively high velocity.

Figure 3:
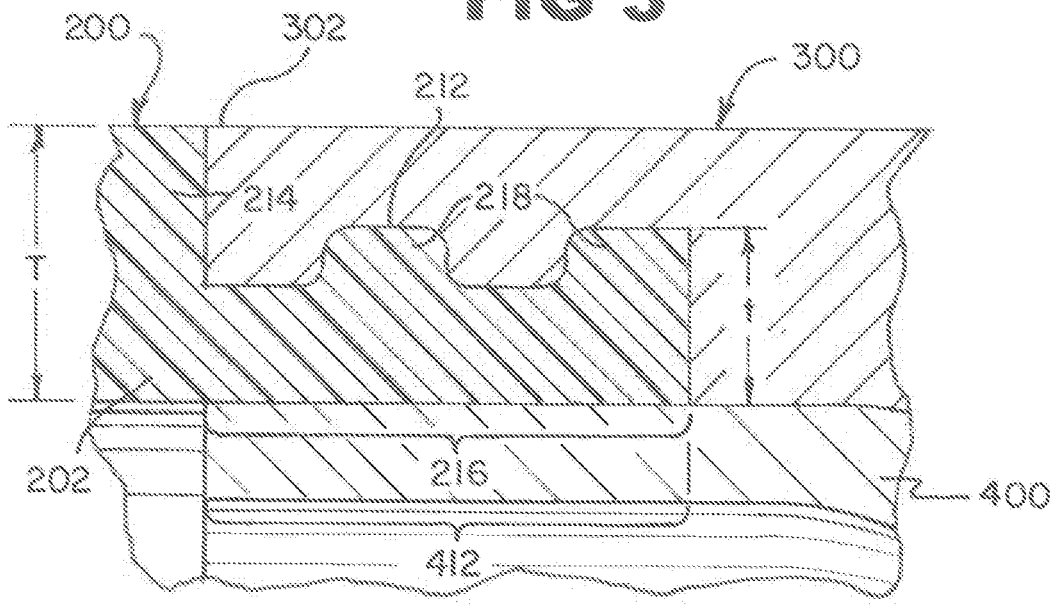
FIG. 3 is a magnified cross-section illustrating an example of the upper component and upper insert of the present invention.

Turning to FIG. 3, the upper insert 300 joins the upper component 200 at an upper insert first end 302. The upper insert 300 is formed from a metal, metal alloy or metal/non-metal alloy. It can be formed by any known method in the art, including turning, milling, hydroforming, casting, cold heading, stamping, etc. In one example, when the upper component 200 is molded, it can be molded under or over the upper insert 300. This is a partial molding since the upper component 200 does not completely cover (or is completely subsumed by) the upper insert 300. In some examples, polymer can cover both the outside and inside of the upper insert 300 and thus the polymer may "sandwich" or flow on both sides of the upper insert 300 (not illustrated). In other examples, the upper insert 300 can just be undermolded, as illustrated, for example in FIG. 9B, or overmolded.

The body 202 includes a wall 214 having a thickness T. The upper component second end 212 has an overlap portion 216, which is the portion of the upper component 200 that engages the upper insert 300. The overlap portion 216 has a thinner wall thickness t, or a second thickness, at the second end 212 than the thickness T of the wall 214 before the overlap portion 216. In examples, this can be an average second thickness as the overlap portion 216 can have bands 218 which can vary the height (see below).

Figure 4:
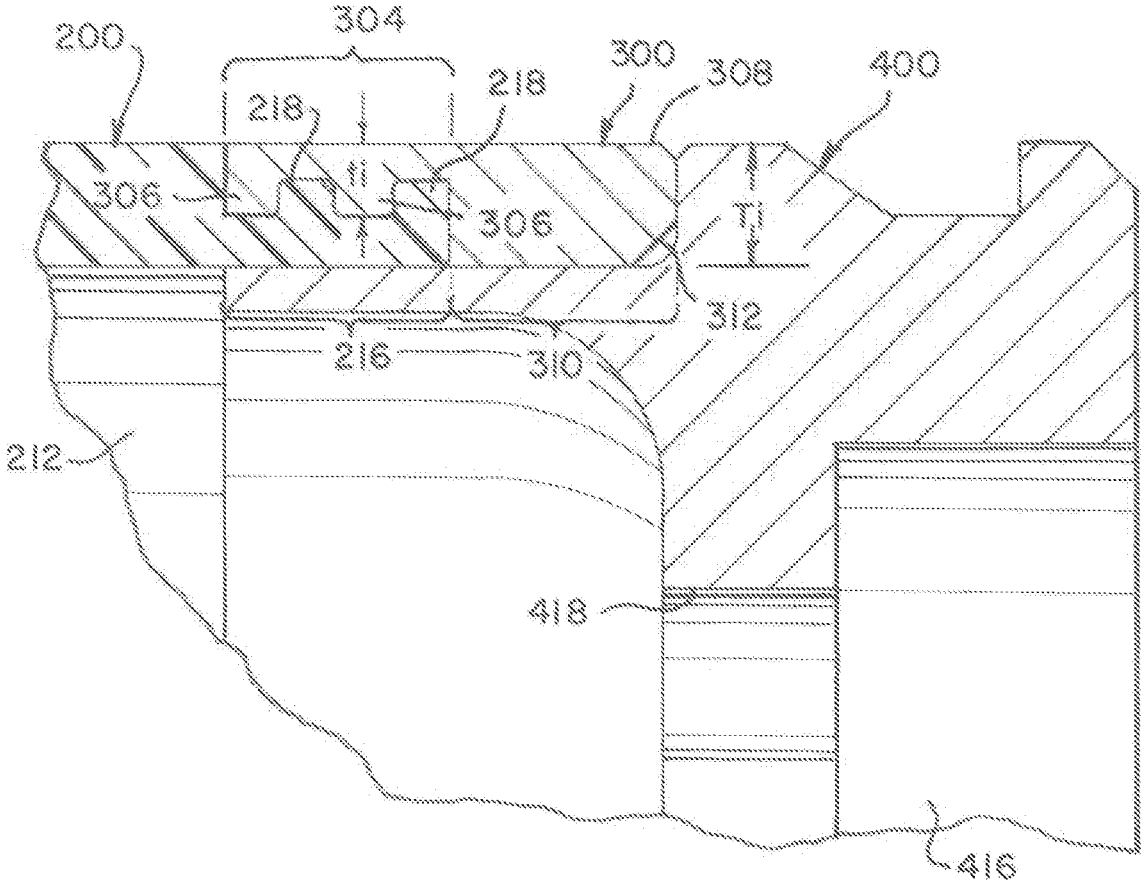
FIG. 4 is a magnified cross-section illustrating an example of the upper component, upper insert, and lower insert of the present invention.
Figure 5:
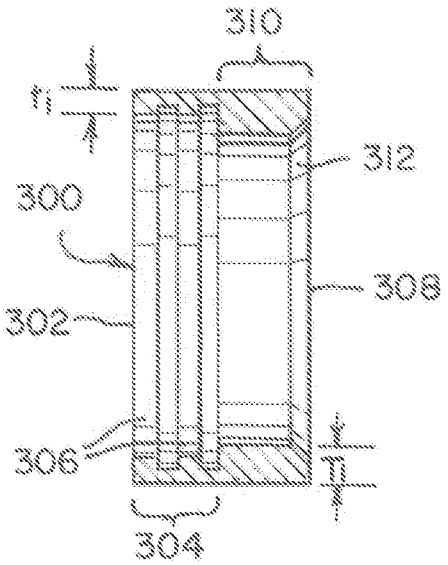
FIG. 5 is a cross-section illustrating an example of the upper insert of the present invention.
Figure 6:
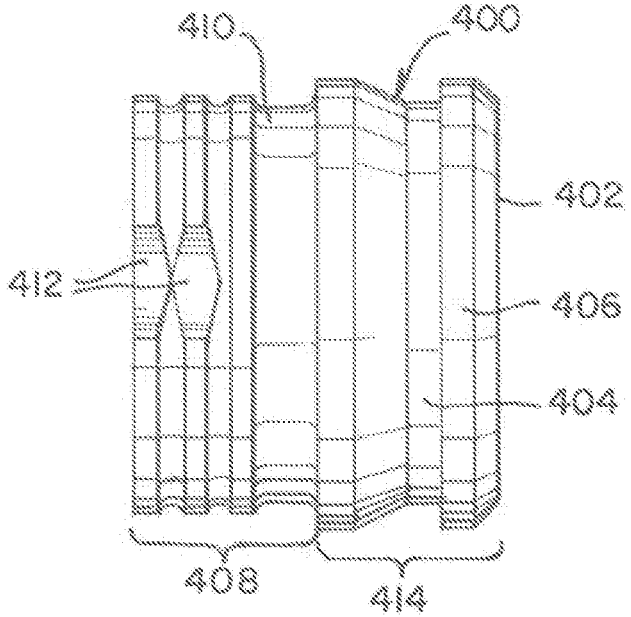
FIG. 6 is a side view of an example of a lower insert.

As illustrated in FIGS. 4 and 5, the upper insert 300 can include an undermolded area 304, where the overlap portion 216 engages the upper insert 300. Note this can also be an overmolded area, where the polymer and metal would just switch sides. The undermolded area 304 has a thickness $t_i$, which can be taken as an average in examples of the undermolded area 304 that have one or more ridges, ribs, knurling, and/or keys 306. The ridges 306 allow the polymer from the overlap portion 216, during molding, to forms bands 218 (see FIG. 2). The combination of the ridges 306 and bands 218 aid in resisting separation between the upper insert 300 and the upper component 200. The resistance is most important during the extraction of the cartridge 100 from the firearm by an extractor (not illustrated).

The undermolded area 304, in an example, can include one or more keys (not illustrated). The keys can be flat surfaces on the ridges 306 that can prevent the upper insert 300 and the upper portion 200 from rotating in relation to one another, i.e. the upper insert 300 twisting around in the upper portion 200. Keys are only an example thereof, and other methods can be used to prevent the relative rotation of the two parts. Other examples can be any surface changes, i.e. dimples, teeth, etc., that perform the same non-rotational function.

The upper insert 300 also has a second end 308 with an insert engagement area 310. The insert engagement area 310 can be the area of the upper insert 300 that engages the lower insert 400. An example of the second end 308 of the upper insert 300 can also have a bevel 312 to ease the insertion of the lower insert 400 into the second end 308.

Further, the insert engagement area 310 has a thickness Ti and this can be equal to or about equal to the wall thickness T of the body wall 214 ($T \approx Ti$) and is greater than the undermolded area thickness $t_i$ ($Ti > t_i$). This allows the upper component 200 and the upper insert 300 to be molded in the same mold with the same pin so as the pin can be easily extracted from the second ends 212, 308. If the upper insert engagement area thickness Ti is greater than the body wall thickness T ($Ti > T$) then the molding pin cannot either properly enter or be extracted from this portion of the molded cartridge. Further to the concept of molding pin insertion, in examples, no barrier can be formed along the length of the upper portion 200. The body 202 can be hollow and uninterrupted from the mouth 208 to the second end 212.

In comparing all of the thicknesses, the examples focus on the wall thickness T, the upper insert engagement area thickness Ti, the overlap portion wall thickness t, and the undermolded (overmolded) area thickness $t_i$. As described above, one object of the invention is to allow molding a bottleneck polymer cartridge 100 with a single molding pin removed from the second ends 212, 308. Thus, the sum of the overlap portion wall thickness t and the undermolded area thickness $t_i$ should not exceed either the wall thickness T or the upper insert engagement area thickness Ti. In mathematical terms $T \approx Ti \approx (t+t_i)$. The values can be exactly equal, or within enough tolerances to allow the molding pin to be inserted on the inside for molding, and the outside dimensions allow the cartridge to be chambered in a weapon chambered for the particular caliber.

Said differently, that the discussions of examples of thicknesses herein are how thick the interior segments of the element are. The outside dimensions on the cartridge case 100 are typically within the tolerances of cases for a particular caliber projectile.

Turning to the insert 400, as illustrated in FIGS. 6-9, a back end 402 of the insert 400 is also the rear end of the casing 100. The insert 400 is formed with an extraction groove 404 and a rim 406. The groove 404 and rim 406 are dimensioned to the specific size as dictated by the caliber of the ammunition. The insert 400 can be formed by turning down bar stock to the specific dimensions, cold formed, cold formed and turned to produce the final design.

The insert 400 includes an upper insert engagement area 408, where the insert engagement area 310 engages the insert 400. The upper insert engagement area 408 can be smooth, have one or more ridges, threads, snaps, etc. 410. The upper insert engagement area 408 allows for a metal-on-metal connection between the upper and lower inserts 300, 400. This connection can be bonded (e.g., adhesives, welds, etc.) and/or mechanical (e.g., friction fit, snap, threading, interference fit, press fit, etc.) or any other metal-on-metal bonding known to those of ordinary skill. The strength of this bond is most important during the extraction of the cartridge from the firearm by an extractor (not illustrated).

The upper insert engagement area 408 can also include a polymer engagement area 412. The polymer engagement area 412 can be any structure that further engages the polymer of the body wall 214. In one example, the engagement can be at the overlap portion 216. This polymer engagement area 412 can add to the strength of maintaining the lower insert 400 engaged with the cartridge 100. Also, the polymer engagement area 412 can prevent the insert 400 and the upper component 200 from rotating in relation to one another, i.e. the insert 400 twisting around. Keys are only an example thereof, and other methods can be used to prevent the relative rotation of the two parts. Other examples can be any surface changes, i.e. dimples, teeth, etc., that perform the same non-rotational function.

Furthermore, the polymer engagement area 412 "pinches" against the overlap portion 216 and can act as a gasket, preventing gases from getting between the polymer of the body 202 and the upper component 300. This gasket effect keeps the polymer that flows into undermolded area 304 from separating away from the insert engagement area 310.

In another example, below the upper insert engagement area 408, toward the back end 402, is a self reinforced area 414. This portion extends to the back end 402 of the lower insert 400 and includes the extraction groove 404 and rim 406. The self reinforced area 414 must, solely by the strength of its materials, withstand the forces exerted by the pressures generated by the gasses when firing the projectile and the forces generated by the extractor. In the present example, the self reinforced area 414 withstands these forces because it is made of a heat treated metal or a metal/non-metal alloy.

FIGS. 7 and 8 illustrate an example of the inside of the lower insert 400. Open along a portion of the back end 402 and continuing partially toward the upper insert engagement area 408 is a primer pocket 416. The primer pocket 416 is dimensioned according to the standards for caliber of the cartridge case and intended use. A primer (not illustrated) is seated in the primer pocket 416, and when stricken causes an explosive force that ignites the propellant (not illustrated) present in the upper component 200.

Forward of the primer pocket 416 is a flash hole 418. Again, the flash hole 418 is dimensioned according to the standards for the caliber of the cartridge case and intended use. The flash hole 418 allows the explosive force of the primer, seated in the primer pocket 418, to communicate with the upper component 200.

In another example, forward of the primer pocket 416 and inside the upper insert engagement area 408 can be a basin 420. The basin 420 is adjacent to and outside of the inner bowl 314 of the lower component 300. The basin 420 is bowl shaped, wherein the walls curve inwards toward the bottom. The bottom of the basin 420 is interrupted by the flash hole 418.

The example of FIG. 9 also includes a belted lower insert 400. The belt 424 can be used to provide headspacing and has a larger outer diameter than the lower component's outer wall. Belted cartridges are used primarily in "magnum" rounds and in some cases to prevent the higher-pressure magnum cartridge from accidentally being chambered in a gun with a chamber of similar size.

The present example can also use, either with or without providing headspacing, the belt 424 as stopping point of the upper insert engagement area 408. Another feature of the lower insert 400 is two ridges 410, to reduce the amount of the insert that is required to be upper insert engagement area 408 by the upper insert 300.

The belt 424 can also be used to stop the insertion of the lower insert 400 into the upper insert 300. The belt 424 can engage the bottom of the bevel 312 and act as a stop.

FIG. 9A further illustrates an example using two ridges 410, instead of three ridges 410 as illustrated and discussed above. In the illustrated two ridge design, the first ridge 410A is wider than the second ridge 410B, to provide the additional surface area that is lacking if there are three or more ridges. The width differential can be approximately 2 to 4 times larger. The ridged design increases the pull strength to separate the lower insert 400 from the upper insert 300, providing additional strength to extract the empty cartridge after firing. Further to the two ridge example, it is easier to machine the insert than the three ridge version, but both are still feasible.

FIG. 9B illustrates a smooth walled "basin" lower insert 400 in cross-section. This example of the lower insert 400 does not have ridges 410. The fit between the upper and lower inserts 300, 400 can be mechanical friction, or any of the other ways noted above. Also illustrated is second bevel 426 on the lower insert 400. The second bevel 426 also aids in the insertion of the lower insert 400 into the upper insert 300. This second bevel 426 is sloped opposite the basin 420.

FIGS. 10-12 illustrate another example with smoother surfaces. As illustrated, the lower insert 400 does not cover the polymer of the overlap portion 216. Further, the top face 421 of the lower insert 400 is "flat". FIGS. 6-9 illustrated an example with the basin 420, this example does not have a basin 420. FIGS. 11A and 11B illustrate another example of the upper insert 300. This illustrates a top bevel 316 to aid in molding. FIGS. 12A and 12B illustrate another example of the lower insert 400. Here, the upper insert engagement area 408 can be smooth and can form an interference fit with the upper insert 300. Further, in this example, the lower insert 400 can only have a rim 406. The extraction groove 404 can be formed from the spacing between the rim 406 and the upper insert 300 and does not need to be machined into the lower insert 400. This can save manufacturing costs.

In examples, the upper and lower inserts 300, 400 engage around the inside of the upper 300 and the outside of the lower 400. The upper insert 300 does not contact, or act as an extension of, the flash hole 418.

Figure 13:
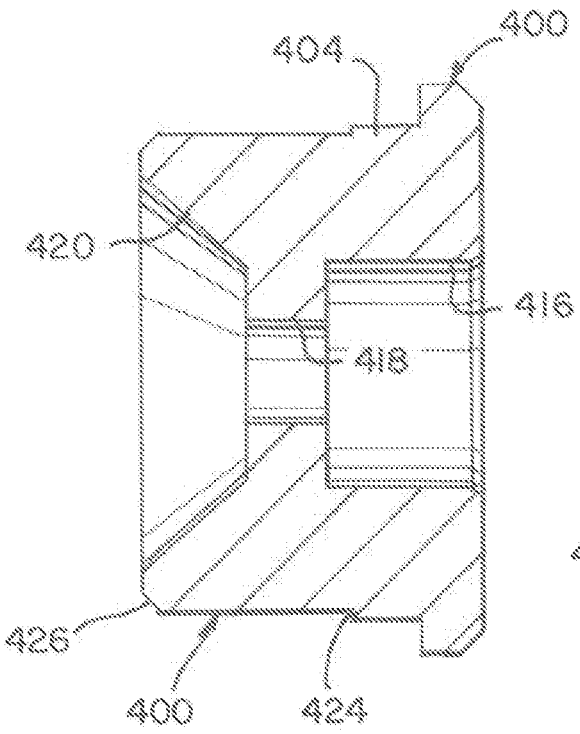
FIG. 13 is a cross-section of another example of a lower insert.
Figure 14:
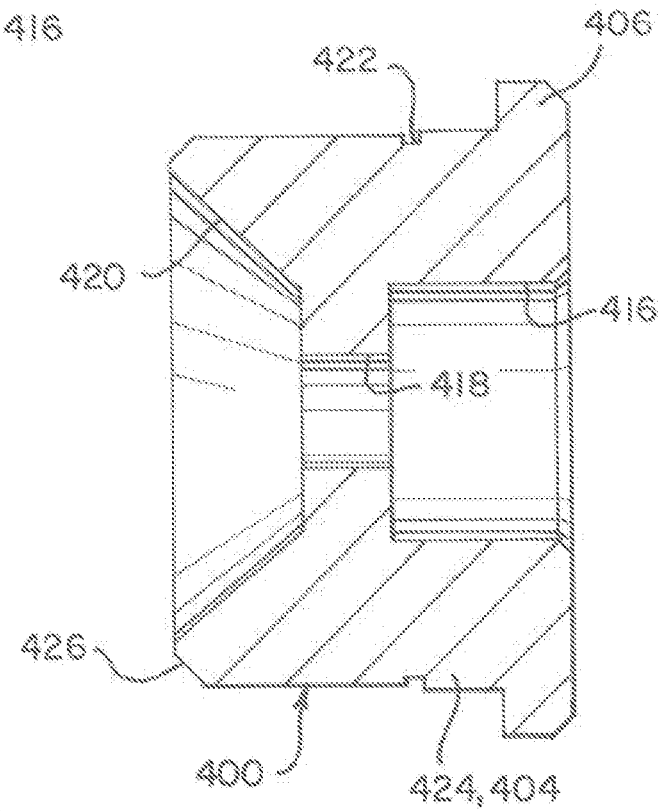
FIG. 14 is a cross-section of a example of a crimped lower insert.

FIG. 13 illustrates another cross-section of a lower insert 400. Here the belt 424 and the groove 404 are similar, where the true stopping point for the insertion of the lower insert 400 into the upper insert 300 is at the edge of the belt, also noted 424. FIG. 14 illustrates the lower inset 400 with a crimp ring 422. The crimp ring 422 can be set, in certain examples, above the belt 424. Once the upper and lower inserts 300, 400 are engaged, the bevel 312 of the upper insert can be crimped into the crimp ring 422. This can be used to increase the strength of the engagement between the upper and lower inserts 300, 400.

Figure 15:
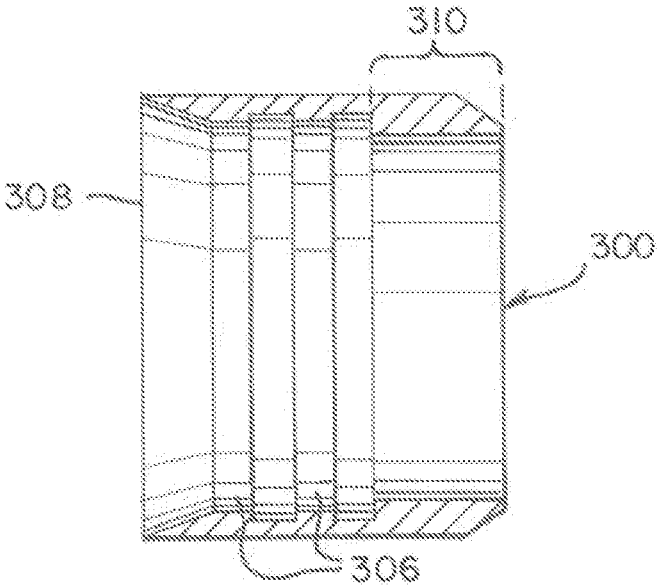
FIG. 15 is a cross-section of yet another example of an upper insert.
Figures 16, 17, 18:
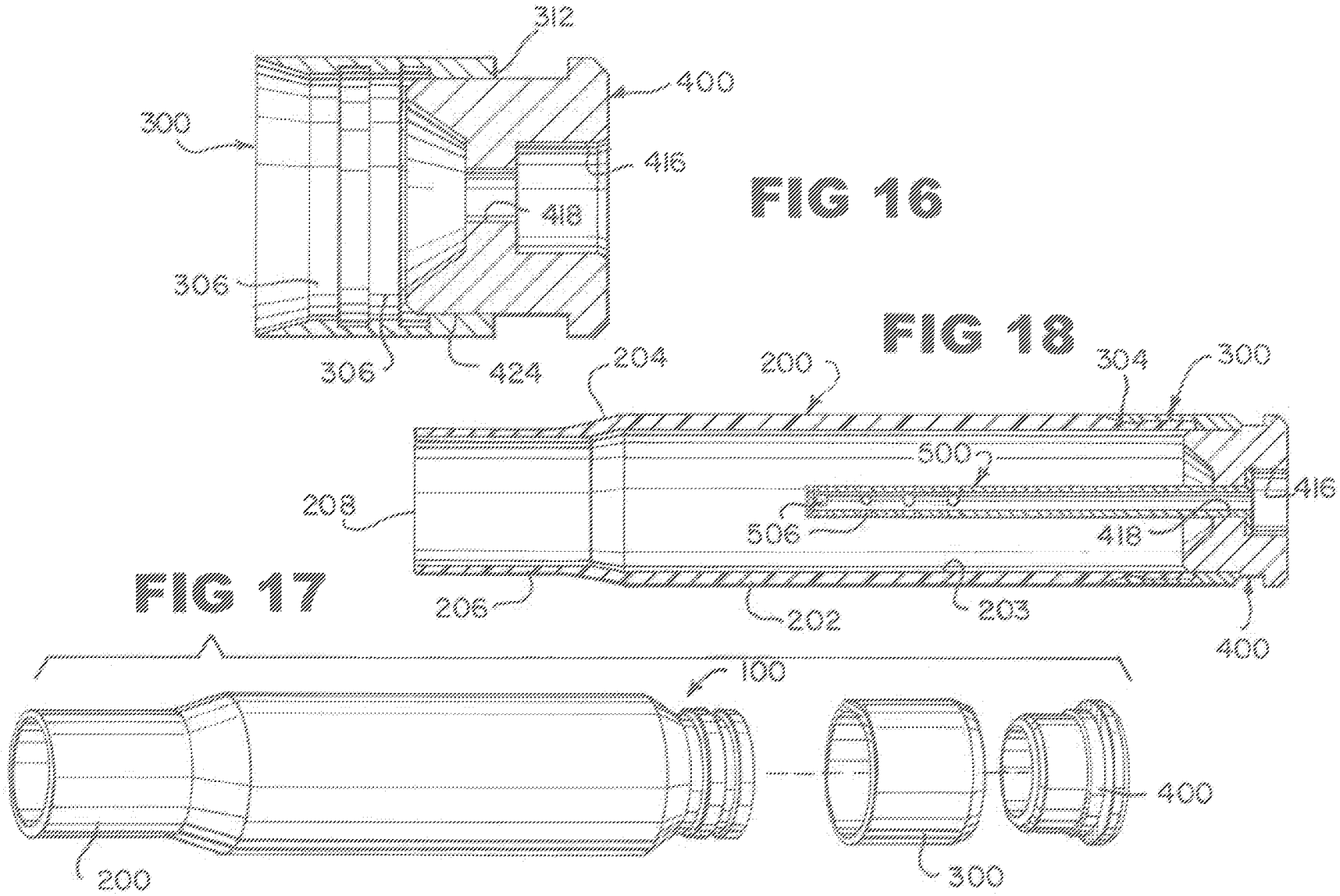
FIG. 16 is a cross-section view of an example of the upper and lower inserts engaged.
FIG. 17 is an exploded view of the entire cartridge.
FIG. 18 is a cross-section view of an example of a flash tube.

FIG. 15 is a cross section of the upper insert 300 prior to engagement with the lower insert 400 and FIG. 16 is another example of the upper and lower inserts 300, 400 engaged. FIG. 17 is an exploded view of the cartridge 100, where the upper component 200 is undermolded into the upper insert 300 and the lower insert 400 is then inserted into the upper component 300.

FIG. 18 introduces another element to the lower insert 400, a flash tube 500. The flash tube 500 can come up from the flash hole 418, through the primer pocket 416 and into the propellant chamber 203. The flash tube 500 can extend any distance into the propellant chamber 203. In examples, the flash tube 500 extends approximately between 50-90% of the propellant chamber, with other examples at approximately ⅔ or ¾ (~66% and ~75%) of the distance to the shoulder 204 or bottom of the projectile.

FIGS. 19A through 19E illustrate separate examples of the flash tube 500. The flash tube 500 has a propellant chamber end 502 and an opposite insert engagement end 504. The flash tube 500 is hollow and extends from the primer pocket 416. FIGS. 19A and 19B illustrate examples where the flash tube 500 is vented using holes. Vent holes 506 perforate the flash tube 500 and can be spaced in any pattern around the flash tube 500 from a single hole to multiple holes around a single perimeter to multiple rows/columns of holes extending along the flash tube 500. FIGS. 19C and 19D illustrate the vent holes as slits 506A. In FIG. 19C, the slits 506A are only at the top portion of the flash tube 500. FIG. 19D illustrates multiple slits 506A in a spaced pattern. FIG. 19E illustrates an example that the flash tube 500 can be solid and a single vent hole 506B can be at the propellant chamber end 502 at the "top". In addition, examples can combine vent holes 506 to include slits 506A and top hole 506B. None of the above is limiting to the size and shape of the venting 506, as any size, shape, and pattern can be used to vent the primer blast.

FIGS. 19A and 19C-E illustrate a washer end 508 to the insert engagement end 504. The washer end 508 is sized to be approximately the same diameter as, or smaller than, the primer pocket 416. FIG. 19B illustrates a threaded end 510 to the insert engagement end 504. In this example the flash tube 500 and the lower insert 400 and/or primer pocket 416 can be joined by a threaded arrangement. The matching threads on the lower insert 400 can be in multiple places. In one example, the matching threads can be inside the flash hole 418 or after the flash hole 518 toward the propellant chamber 203. Note that while a press fit and threaded engagement are illustrated and described, this is not limiting to the ways known to attach the two elements.

Figure 20:
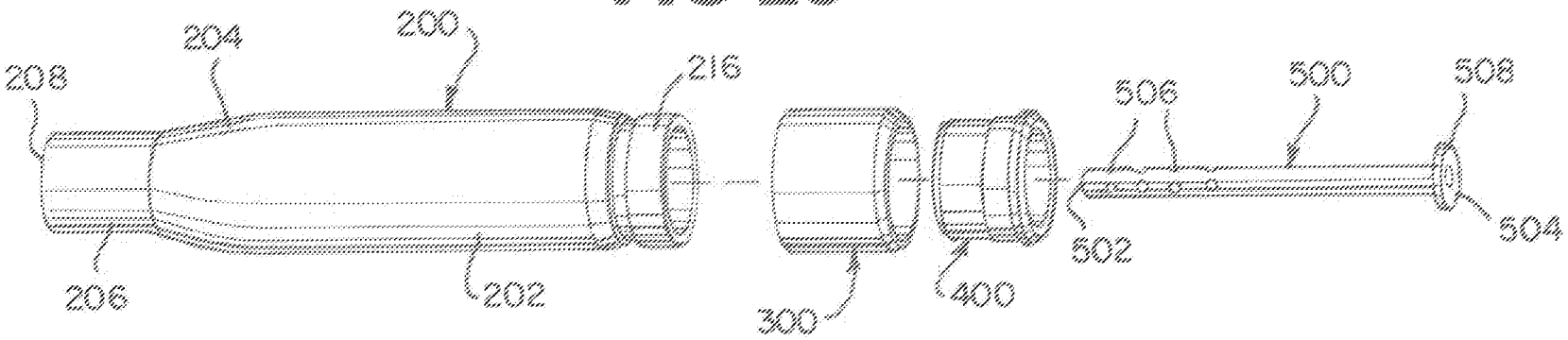
FIG. 20 is an exploded view of an example of the entire cartridge, including a flashtube.
Figure 21B:
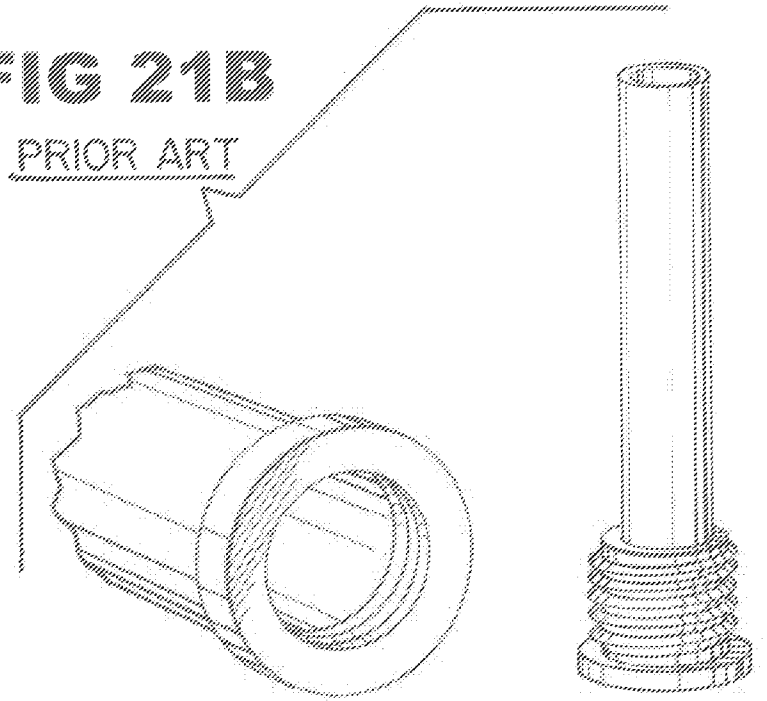
FIG 21B PRIOR ART
FIGS. 21A and 21B are prior art flash tube structures for brass cartridges.
Figure 21A:
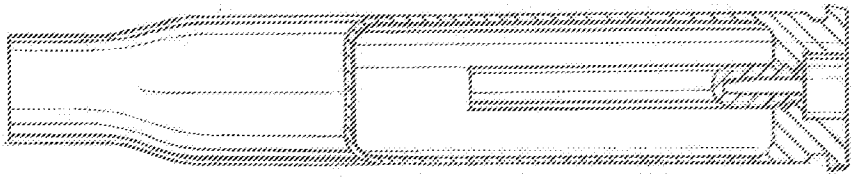
FIG 21A PRIOR ART

FIG. 20 illustrates an example of engaging the flash tube 500 which can involve inserting the propellant chamber end 502 through both the primer pocket 416 and the flash hole 418 until the washer end 508 is stopped by where the primer pocket 416 ends. In this example, the flash tube 500 takes all of the primer charge and the flash hole 418 can be said not to be used. As above, the flash tube 500 and the lower insert 400 and/or primer pocket 416 can be joined by bonding (e.g., adhesives, welds, etc.), mechanical processes (e.g., friction fit, snap, threading, interference fit, press fit, etc.) or any other metal-on-metal bonding known to those of ordinary skill. Alternately, the flash tube 500 can be fitted up through the primer pocket 416 and flash hole 418 and then screwed into place or can be inserted from the top, or the mouth 208, and screwed in on top of the lower insert 400. In all regards, the flash tube 500 is fluidly connected to the primer pocket 416 so that the primer ignition passes from the primer pocket 416 and out the vent hole 506 to ignite the propellant in the propellant chamber 203. The flash tube 500 can pass it directly or it can first pass through the flash hole 418 and into the flash tube 500.

All examples contemplate that the flash tube 500 can be preassembled to the lower insert 400 before the lower insert 400 is engaged to the upper insert 300 or assembled after engagement. Additionally, the flash tube 500 can be manufactured directly into the lower insert 400, removing extra assembly steps.

As noted above, the use of a flash tube 500 can reduce the amount of propellant needed to generate a given pressure in comparison to the amount of propellant needed without the tube 500. This allows for different configurations where more propellant is used (to fill the propellant chamber 203) to increase pressures and increase the velocity of the discharged projectile. Alternately, the size of the propellant chamber can be reduced to accommodate the reduced propellant load. These reductions can extend to not only typical ammunition, but blank and subsonic ammunition, reducing the propellant load even further. See, at least U.S. Pat. Nos. 8,763,535 and 9,003,973, which are incorporated herein by reference.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A high strength polymer-based cartridge casing comprising:

an upper polymer component, molded from a polymer, comprising:
- a front end having a mouth; and
- at least a wall between the front end and a back end of the upper component opposite the front end; and
- an overlap portion extending from an intermediate end of the wall and terminating at the back end of the wall, wherein the overlap portion has a reduced thickness relative to thickness of the wall at the intermediate end;

an upper insert having a first end and an opposing second end, comprising:
- an overlap portion engagement area disposed approximate the first end, wherein the overlap portion engagement area comprises an undermolded or an overmolded area configured to engage the overlap portion to join the upper polymer component and the upper insert;
- an insert engagement area disposed approximate to the second end;

a lower insert, having a top end and a bottom end, comprising:
- an upper insert engagement area engaging with the insert engagement area;
- a rim and groove disposed around an outside of the lower insert;
- a primer pocket disposed inside the bottom end; and
- a flash hole, inside the lower insert and communicating between the primer pocket and upper polymer component, wherein the upper insert and the lower insert are made from a metal, an alloy of metals, or an alloy of a metal and a non-metal.

2. The high strength polymer-based cartridge casing of claim 1, wherein the overlap portion engagement area further comprises one or more structural elements selected from the group consisting of ridges, ribs, knurling, keys, dimples, and teeth shaped to resist rotational and axial separation between the upper insert and the upper polymer component.

* * * * *